US007607323B1

(12) United States Patent
Hall

(10) Patent No.: US 7,607,323 B1
(45) Date of Patent: Oct. 27, 2009

(54) CURL RESISTANT SHIRT COLLAR AND METHOD OF FABRICATING SAME

(76) Inventor: Charles F. Hall, P.O. Box 1025, Lumberton, NC (US) 28359

( * ) Notice: Subject to any disclaimer, the term of this patent is extended or adjusted under 35 U.S.C. 154(b) by 48 days.

(21) Appl. No.: 11/974,796

(22) Filed: Oct. 16, 2007

(51) Int. Cl.
*D04B 9/42* (2006.01)

(52) U.S. Cl. ..... 66/173; 66/170

(58) Field of Classification Search ..... 66/169 R, 66/170, 172 R, 173, 190; 223/84; 2/255, 2/132, 134

See application file for complete search history.

(56) References Cited

U.S. PATENT DOCUMENTS

| | | | | | |
|---|---|---|---|---|---|
| 1,105,407 | A | | 7/1914 | Curtis | |
| 1,167,732 | A | | 1/1916 | Whelen | |
| 1,283,698 | A | * | 11/1918 | Doty | 2/132 |
| 1,845,884 | A | * | 2/1932 | Marinsky | 2/116 |
| 2,769,979 | A | | 11/1956 | Driesbach | 2/132 |
| 3,030,630 | A | * | 4/1962 | Kattermann | 2/116 |
| 3,286,278 | A | | 11/1966 | O'Connor | 2/116 |
| 3,909,850 | A | * | 10/1975 | Scott | 2/132 |
| 4,038,840 | A | | 8/1977 | Castello | 66/170 |
| 4,169,753 | A | * | 10/1979 | Wendell | 156/160 |
| 4,286,337 | A | | 9/1981 | Malouf, Jr. | 2/116 |
| 6,167,732 | B1 | | 1/2001 | Friedman | 66/173 |
| 6,682,743 | B2 | | 1/2004 | Mayr | 424/199.1 |
| 6,708,344 | B2 | * | 3/2004 | Friedman | 2/132 |
| 6,862,743 | B2 | * | 3/2005 | Friedman | 2/132 |

* cited by examiner

*Primary Examiner*—Danny Worrell
(74) *Attorney, Agent, or Firm*—K & L Gates LLP

(57) ABSTRACT

A knitted collar for a casual shirt is made resistive to a tendency to curl by forming the collar of a knitted fabric with pockets at opposite end edges to hold stays. Each pocket is formed of two fabric plys defining an internal channel extending alongside the collar edge. The plys are substantially unattached to one another except for a stitch connecting the plys only at an intermediate location. The stay is of a width dimension sufficiently more narrow than the channel for insertion through an open end of the channel and past the stitch to retain the stay within the channel between a closed end of the channel and the stitch.

16 Claims, 1 Drawing Sheet

CURL RESISTANT SHIRT COLLAR AND METHOD OF FABRICATING SAME

BACKGROUND OF THE INVENTION

The present invention relates to shirt collars made of knitted fabric and, more particularly, to collar constructions adapted to resist the tendency or potential for knitted fabrics to curl at a fabric edge and to methods of fabricating collars so as to impart such curl-resistant characteristics.

Sportswear, in general, and knitted sport shirts, in particular, have grown in popularity over recent years. Such sport shirts are typically designed for casual wear, sports activities such as golf, and the like. As such, such sport shirts are most commonly fabricated from knitted textile fabrics owing to the greater flexibility, stretchability and comfortable hand of such fabrics, and in turn better performance of such shirts during sports and casual activities, as compared to woven fabrics. Knitted sport shirts typically include a knitted fabric collar, almost always made as a separate fabric component. Most typically, knitted sport shirt collars are formed on a flatbed knitting machine best suited to fashioning the collar to desire dimensions and contours and with finished edges.

One disadvantage of conventional flatbed-knitted sport shirt collars is that such collars tend to curl at the edges of the knitted fabric, particularly the angular corner edges which border the neck opening of a sport shirt. Such collars are ordinarily formed of a rib knit structure, which presents an identically knitted fabric surface on both front and back faces of the fabric and thereby exhibits a somewhat greater tendency of the fabric to hold a flattened condition and to resist curling. Even so, knitted sportswear collars still tend to curl at the edges, particularly after the garment has been washed.

It has been proposed in the past to form such knitted sport shirt collars with pockets containing plastic stays strategically located at the edges of the collar, as a means of imparting to the collar structure a defined shape which resists a tendency of the knitted fabric to curl at its edges. U.S. Pat. No. 3,286,278, issued to R. R. O'Connor, U.S. Pat. No. 6,167,732 issued to Friedman, and U.S. Pat. No. 6,862,743 also issued to Friedman disclose differing approaches to this concept. Specifically, the O'Connor patent suggests the formation of the pocket to be oversized in relation to the plastic stay to enable the stay to be easily inserted, but in turn the stay can tend to shift and move within the pocket, which detracts both from the appearance of the collar and from the effectiveness of the stay in retaining the collar shape and resisting curling. Friedman U.S. Pat. No. 6,167,732 suggests, by contrast, forming the pocket of a width nearly identical to, or at least closely matched to, that of the stay to prevent shifting of the stay within the pocket, but in actual practice, such construction increases the difficulty during manufacture to insert the stay. As a result, it is believed that collars actually manufactured according to the Friedman patent are formed with a buttonhole-like opening in the underside of the collar fabric to facilitate insertion of the stay, as described in Friedman U.S. Pat. No. 6,862,743, but during laundering and wearing of the sport shirt, the stay can tend to work its way out of the pocket through the hole, thereby defeating the purpose of the stay.

SUMMARY OF THE INVENTION

It is accordingly an object of the present invention to provide an improved knitted sport shirt collar adapted to receive an anti-curling collar stay, which addresses the problems and disadvantages of known knitted collars such as described above. More particularly, it is an object of the present invention to provide a knitted collar construction wherein the insertion of stays into receiving pockets within the collar is relatively easy to accomplish, but is still effective to retain the stays against undesirable shifting over the course of use. A further object of the present invention is to provide an improved methodology by which the present collar may be fabricated.

Briefly summarized, the present invention addresses these objectives by providing a knitted collar adapted for use in a casual shirt, such as a sport shirt, wherein the collar is formed of a knitted fabric with a pocket portion at an edge of the collar containing a stay, uniquely retained in place within the pocket by a strategically located stitch formed in the collar fabric. More specifically, the knitted fabric of the collar forms the pocket portion of two fabric plys defining therebetween an internal channel which extends alongside the edge of the collar between an end of the channel which is closed and another end of the channel which is open. The fabric plys forming the pocket are substantially unattached to one another, except for the aforementioned stitch, which connects the two plys substantially only at a location intermediate a lengthwise dimension of the channel between its open and closed ends. The stay is of a selected widthwise dimension sufficiently more narrow than the channel for permitting insertion of the stay through the open end of the channel and to one side of the stitch for insertion past the stitch, whereby the stay can be inserted into a disposition within the channel to reside between the closed end of the channel and the stitch and to be retained in such disposition by the stitch. As such, the collar is characterized by the edge of the collar adjacent the pocket being resistive to a tendency of the collar to curl, and owing to the stitch, being likewise resistive to shifting of the stay out of its inserted disposition.

In a preferred embodiment of the knitted collar, the main body of the knitted fabric is comprised of a single fabric ply, most preferably a rib knit structure. The two fabric plys defining the pocket for the stay may be formed of a plain knit structure, e.g., a single jersey structure. The stitch connecting the two fabric plys may be formed as one or more tuck stitches interknitted between the two fabric plys, such as in an embodiment wherein the fabric plys are each of a single jersey construction. The tuck stitch is preferably located intermediate a widthwise dimension of the channel. In substantially all commercial embodiments of the collar, the collar will have two edges at opposite ends of the fabric with two pockets, each holding a stay, respectively alongside the two edges.

The stay may be of any suitable configuration and material, but it is believed most optimal that the stay be formed of plastic and, to facilitate ease of insertion, a leading end of the stay, in the direction of insertion, is preferably rounded, with a trailing end of the stay, in the direction of insertion, being formed as a squared-off, essentially linear end edge. When inserted, the rounded end of the stay is disposed in adjacent facing relation to the closed end of the channel, while the linear end edge of the stay extends generally perpendicularly across the channel adjacent and in adjacent facing relation to the stitch.

DETAILED DESCRIPTION OF THE PREFERRED EMBODIMENT

Figure 1:
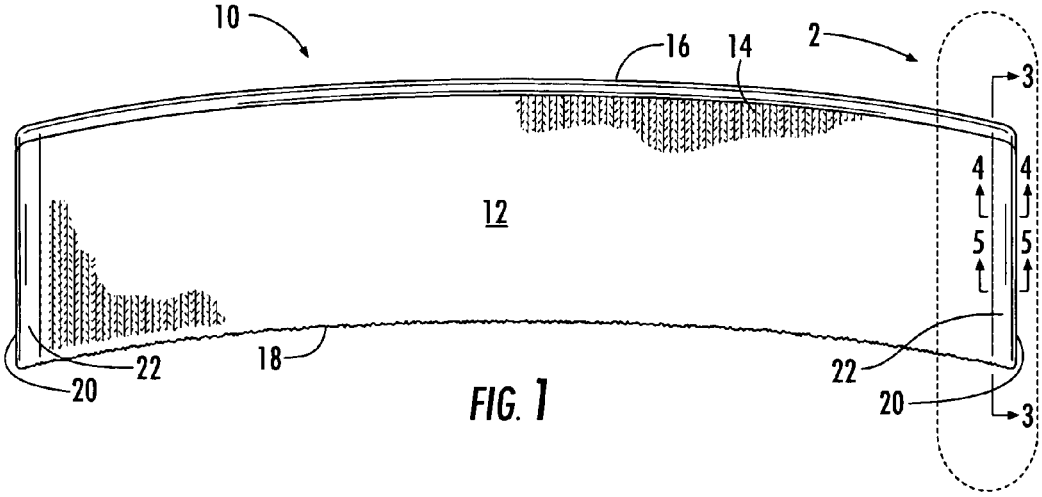
FIG. 1 is an elevational view of a knitted collar for a casual sport shirt, made in accordance with a preferred embodiment of the present invention.

Referring now to the accompanying drawings and initially to FIG. 1, a knitted collar in accordance with a preferred embodiment of the present invention is indicated overall by the reference numeral 10 and basically comprises a flat elongate piece of integrally knitted fabric 12 of a predetermined length and width and with a slightly curved lengthwise contour suitable to be folded and sewn to the open neck of a conventional knitted sport shirt (not shown), such as a golf shirt, to form a collar portion thereof.

The fabric 12 of the collar 10 has a main body portion 14 comprising the predominant majority of the length and width of the fabric 12, extending from a slightly curved front edge 16, extending the full width of the fabric 12 and formed by closed knitted fabric loops to present a finished outer edge to the collar 10, to a similarly curved rear edge 18, also extending the full width of the fabric but left unfinished by a series of open knitted fabric loops. The unfinished rear fabric edge 18 thereby provides the fabric extent intended to be sewn into the open collar of the sport shirt. At the opposite end edges 20 of the collar 12, the main body 14 of the fabric is integrally knitted with relatively narrow pocket portions 22 which extend along the entirety of each end edge 20 to define an interior channel 24 (FIGS. 2-5) which is closed at the end of the pocket portions adjacent the front fabric edge 16 and open at the end of the pocket portions 22 adjacent the rear fabric edge 18.

The knitted fabric 12 of the collar 10 may be made of varying forms of knitted fabric structures. In a presently preferred embodiment, the fabric 12 is knitted with its main body 14 of a single ply knitted structure, represented at 26 in FIGS. 4 and 5, with the pocket portions 22 of the fabric 12 each being formed of dual overlying fabric plys, represented at 28 in FIGS. 3-5, for defining therebetween the channels 24. While various differing knitted fabric structures may be selected for forming the main body 14 and pocket portions 22 of the collar fabric 12, one presently preferred and contemplated embodiment of the collar 10 forms the main body 14 of the fabric 12 as a rib knit structure, schematically represented at 26 in FIGS. 4 and 5, as such a rib knitted structure presents an identical construction and appearance at each opposite face of the fabric, which makes assemblage into a garment easier and also has a somewhat greater tendency than other knit structures to maintain a flattened non-curling appearance when incorporated into a garment. The pocket portions 22, on the other hand, may advantageously be formed with each overlying fabric ply 28 of a single jersey knit structure, which as more fully described hereinafter facilitates the separate formation of the dual plys 28 and also presents an overall thickness of the dual plys 28 approximating that of the rib structure of the main body 14.

The pocket portions 22 of the collar fabric 12 are intended to receive an elongate plastic stay 30 interiorly within the channel 24 of each pocket portion 22 to resist an inherit tendency of knitted fabric to curl at the edges thereof, known to be most accentuated in a knitted fabric collar at fabric corner areas such as the juncture between the end edges 20 and the front edge 16 which will form the exposed front edges of a collar portion in a finished sport shirt. The plastic stay 30, as is conventional, will preferably comprise a relatively flat narrow elongate length of a plastic material having a sufficiently greater stiffness than the knitted fabric 12 itself to counteract any inherit tendency of the fabric to curl, but which is also sufficiently flexible and resilient to yield and recover in normal laundering and use of a sport shirt in which the collar 10 is incorporated.

As noted, the use of a stay in a pocket area within a knitted collar is known, but it is also known that the insertion of a plastic stay into a pocket portion becomes increasingly more difficult with closer dimensional tolerances between the stay and the pocket, but also the provision of the pocket with a greater dimensional clearance for the stay risks a tendency for the stay to shift within or work out of the pocket during use. Accordingly, the present invention contemplates the formation of one or more discrete stitches joining the two plys 28 of each pocket portion 22 at as strategic location to retain the stay 30 in place after it has been originally inserted into the channel 24 of each pocket portion 22, whereby in turn the pocket portion 22 can be formed of an oversized width relative to that of the stay 30.

Figure 2:
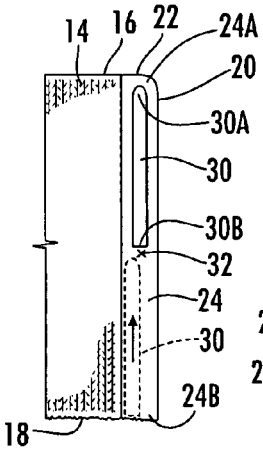
FIG. 2 is a detailed elevational view of an end section of the collar of FIG. 1, indicated at 2 therein, with one ply of the pocket broken away to reveal the interior channel of the pocket.
Figure 3:
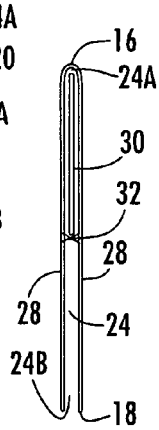
FIG. 3 is a cross-sectional view taken through the collar of FIG. 1 along line 3-3 thereof.
Figure 4:
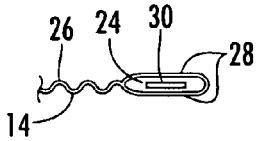
FIG. 4 is a cross sectional view through the end section of the collar of FIG. 1, taken along line 4-4 thereof.
Figure 5:
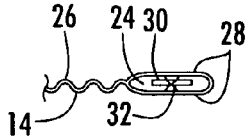
FIG. 5 is another cross-sectional view through the end section of the collar of FIG. 1 along line 5-5 thereof.

More specifically, as depicted in FIGS. 2, 3 and 5, the strategically located stitch is indicated at 32 connecting the overlying plys 28 of each pocket portion 22, but otherwise the plys 28 of each pocket portion 22 are unconnected to one another leaving each channel 24 clear for the unimpeded insertion of the stay 30. As will be understood, the lengthwise dimension of the stay 30 will originally be selected in relation to be intended size of the collar 10 as determined by the sport shirt in which the collar 10 is to be utilized. In turn, the stitch 32 is formed within each pocket portion 22 at a location intermediately along the overall length of the channel 24 at a rearward distance from its forward closed end 24A only slightly greater than the lengthwise dimension of the selected stay 30, and at such location, the stitch 32 is positioned intermediate the widthwise dimension of the channel 24 leaving an open widthwise channel space on at least one side of the stitch 32. The overall width of each channel 24 is sufficiently larger than the width of the stay 30 to permit the stay to be inserted into each channel 24 through its rearward open end 24B and to move forwardly through the channel 24 to the widthwise side of the stitch 32 so as to pass the stitch 32 in moving the stay 30 into its final disposition residing within the forward extent of the channel 24 between its closed end 24A and the stitch 32. Once the stay 30 is situated within the channel 24 forwardly of the stitch 32, the stay 30 is permitted to rest centrally within the channel 24, whereby the stitch 32 serves to resist unintended movement of the stay 30 rearwardly past the stitch 32 and potentially out of the channel 24.

It is preferred that there be a relatively close tolerance between the widthwise dimension of the plastic stay 30 and the widthwise spacing within each channel 24 laterally to the widthwise side of the stitch 32. Owing to the inherit flexibility and stretchability of knitted fabrics, the stay 30 may be of a width slightly greater than the widthwise open space within each channel 24 to opposite sides of the stitch 32, with the stitch 32 and the fabric 12 being sufficiently yieldable to permit the stay to pass the stitch 32 as it is inserted into the channel 24. It is further preferred under the present invention that the stay 30 is formed with a rounded leading end 32A, as best seen in FIG. 2, which promotes ease of sliding the stay 30 through the channel 24 past the stitch 32. On the other hand, it is similarly contemplated that the trailing end of the stay 30 may be formed with a squared-off linear edge 30B so that, once the stay 30 is situated within the channel 24 forwardly of the stitch 32, the linear trailing end 30B assists in deterring the stay 30 from shifting out of its intended position past the stitch 32. For greater security in resisting shifting movement of the stay 30, if needed or desired, the stay could be formed with a notch (not shown) in its linear rear edge 30B to rest essentially against the stitch 32.

The stitch 32 may be formed in differing manners to connect the overlying plys 28 of each pocket portion 22, but it is considered to be preferable that the stitch 32 be formed as one or more knitted tuck stitches, whereby the stitch may be formed automatically during the knitting process by setting up the pattern control of the knitting machine to selectively form such stitch at the appropriate point during the overall knitting of the fabric 12, as those persons skilled in the knitting art will readily recognize. However, the present invention is not limited to the use of a tuck stitch as the retaining stitch 32 but instead the present invention is considered to extend to any other form of a stitch, such as a sewn stitch, or any other form of localized connection between the dual fabric plys 28 of the pocket portions 22.

A collar 10 formed in accordance with the construction above-described may advantageously be knitted on a jacquard-type dual-bed flat knitting machine. Such knitting machines are well known within the knitting industry so as not to require detailed illustration or description herein. Basically, such machines comprise a pair of linear flat needle beds each supporting a series of independently actuable knitting needles, with the beds oriented angularly with respect to one another with their respective needles offset in staggered relationship for selective manipulation of the needles of each bed relative to those of the other bed as yarn is delivered to the needles progressively back and forth along the length of the needle beds at the junction therebetween via a reciprocating yarn carriage. As the yarn is delivered progressively back and forth to the needles of each bed, a knitted fabric is progressively formed in needle loops aligned horizontally in courses and vertically in wales to form a fabric of a width determined by the width and gauge (spacing) of the active needles in the needle beds and a length determined by the period of time over which the progressive knitting is carried out. In one well known operational setup of such a knitting machine, the knitting needles of the respective needle beds interact with one another to form yarn into a single ply rib knitted structure, such as is contemplated for the main body 14 of the present collar fabric 12 as described above. Owing to the ability of such a machine for individual selectivity and actuation of the respective needles of each needle bed, the respective needle beds, or selected needles within the respective needle beds, can also be set up to operate independently from the needles of the other needle bed to form dual unconnected fabric plys each of a single jersey knit structure, as contemplated for the pocket portions 22 of the present collar fabric 12 as above-described.

Figure 6:
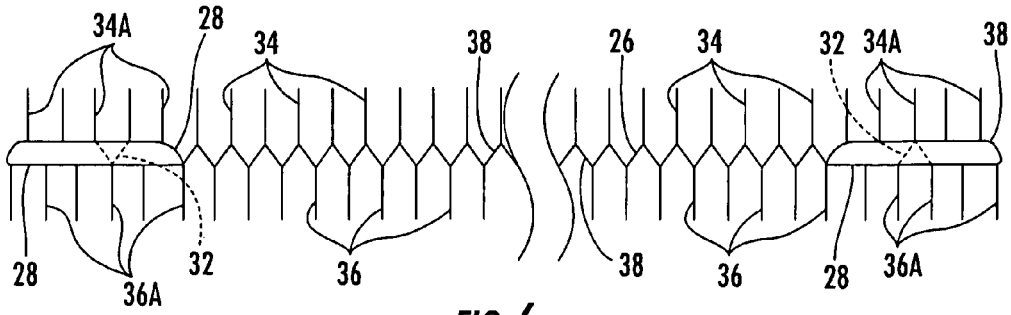
FIG. 6 is schematic diagram depicting the manner of manufacture of the collar of FIG. 1 on a dual-bed flat jacquard knitting machine.

Thus, the use of such a jacquard dual-bed flat knitting machine to produce the collar fabric 12 of the present invention may be understood by illustration of the machine components in the simplified schematic and diagrammatic form of FIG. 6 wherein the individually controllable needles of one needle bed are indicated at 34 and the individually controllable needles of the other needle bed are indicated at 36. Within a central length of each needle bed 34, 36, the needles are activated to cooperatively interact with one another to form yarn 38 into a rib knit structure, as represented at 26, but a selected number of needles, designated at 34A, 36A at the opposite ends of each needle bed, respectively, are separately and differently controlled to manipulate the yarn 38 into separate overlying plys of fabric of a single jersey knit structure, as represented at 28. At a predetermined time over the course of the overall knitting of the collar fabric 12, one of the designated jersey needles 34A, 36A at each opposite end of the knitting machine is manipulated to form one or more tuck stitches rather than a full jersey stitch, thereby causing the yarn to extend between and connect the two plys 28 at such tuck stitch, as indicated in broken lines at 32 in FIG. 6.

Of course, those persons skilled in the art will recognize the possibility of producing a collar of the basic construction as the collar 10 utilizing other forms of knitting machines, or other knit structures, and therefore the description herein of the jacquard flat knitting of the collar 10 is intended to only be illustrative and exemplary but not to limit the scope of the present invention. These and other variations on the fundamental teaching of the present invention are intended to be within the scope and concept of this invention.

The advantages of collars made in accordance with the present invention will be readily recognized and understood by those persons skilled in the art. By the provision of the stitch 32 joining the dual plys 28 of the pocket portions of the collar 10, the channel 24 of the pocket portions 22 and the plastic stay 30 need not be formed to such close tolerances as to be nearly identical in dimension, but instead the channel 24 within the pocket portions 22 may be oversized relative to the stay 30 to best facilitate ease of insertion of the stay into the pocket portions of the collar. Despite an oversized relationship of the pocket portions relative to the stay, the stitch utilized in the present invention serves to securely retain the stay against undesirable shifting within and potentially out of the channel within the pocket portions. The present invention therefore achieves the resistance to curling of the collar fabric intended to be imparted by the use of a plastic stay but without the disadvantages of prior attempts to implement the use of plastic stays in knitted collars.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A knitted collar for a casual shirt characterized by an edge of the collar which is resistive to a tendency of the collar to curl, the collar being formed of a knitted fabric having a pocket portion at the edge of the collar comprised of two fabric plys defining therebetween an internal channel extending alongside the edge of the collar between a closed channel end and an open channel end, the plys being substantially unattached to one another except for a stitch connecting the two plys only at a location intermediate a length dimension of the channel between the closed and open channel ends and only over less than a width dimension of the channel, the unattached plys adjacent the stitch in the width dimension of the channel defining an unattached space between the plys, and a stay disposed within the channel between the closed channel end and the stitch and retained therein by the stitch, the stay being of a width dimension sufficiently more narrow than the channel for permitting insertion through the open end of the channel, through the unattached space adjacent the stitch, and past the stitch and being of a sufficient stiffness to resist a tendency of the fabric to curl at the edge.

2. A knitted collar for a casual shirt according to claim 1, wherein the location of the stitch is intermediate the width dimension of the channel with the unattached plys adjacent the stitch in the width dimension of the channel defining unattached spaces at opposite widthwise sides of the stitch.

3. A knitted collar for a casual shirt according to claim 1, wherein the stitch is a tuck stitch knitted between the two fabric plys at the location.

4. A knitted collar for a casual shirt according to claim 1, wherein the knitted fabric has a main body comprised of a single fabric ply.

5. A knitted collar for a casual shirt according to claim 4, wherein the main body of the knitted fabric is a rib knit structure.

6. A knitted collar for a casual shirt according to claim 1, wherein the collar has two edges respectively at opposite ends of the fabric and two pocket portions, each having a stay, respectively alongside the two edges.

7. A knitted collar for a casual shirt according to claim 1, wherein the stay has an essentially linear end edge extending generally perpendicularly across the channel in facing relation to the stitch.

8. A knitted collar for a casual shirt according to claim 7, wherein the stay has rounded end edge opposite the linear end edge and disposed in facing relation to the closed channel end.

9. A method of forming a knitted collar for a casual shirt characterized by an edge of the collar which is resistive to a tendency of the collar to curl, the method comprising the steps of forming a knitted fabric having a pocket portion at an edge of the fabric comprised of two fabric plys substantially unattached to one another and defining there between an internal channel extending alongside the fabric edge between a closed channel end and an open channel end, connecting the plys by a stitch therebetween only at a location intermediate a length dimension of the channel between the closed and open channel ends and only over less than a width dimension of the channel, the unattached plys adjacent the stitch in the width dimension of the channel defining an unattached space between the plys, providing a stay of a width dimension sufficiently more narrow than the channel to pass through the channel alongside the stitch and of a sufficient stiffness to resist a tendency of the fabric to curl, inserting the stay into and through the open end of the channel, through the unattached space adjacent the stitch and past the stitch into a disposition between the closed channel end and the stitch, and retained the stay within the channel by the stitch.

10. A method of forming a knitted collar for a casual shirt according to claim 9, wherein the location of the stitch is intermediate the width dimension of the channel with the unattached plys adjacent the stitch in the width dimension of the channel defining unattached spaces at opposite widthwise sides of the stitch.

11. A method of forming a knitted collar for a casual shirt according to claim 9, wherein the connecting of the fabric plys by a stitch comprises knitting a tuck stitch between the plys during the forming of the knitted fabric.

12. A method of forming a knitted collar for a casual shirt according to claim 9, wherein the forming of the knitted fabric comprises knitting a main collar body of a single fabric ply.

13. A method of forming a knitted collar for a casual shirt according to claim 12, wherein the knitting of the main collar body comprises knitting a rib knit structure as the single fabric ply.

14. A method of forming a knitted collar for a casual shirt according to claim 9, wherein the forming of the knitted fabric comprises forming two pocket portions at two opposite end edges of the fabric and inserting two stays respectively in the two pocket portions.

15. A method of forming a knitted collar for a casual shirt according to claim 9, wherein providing the stay comprises forming the stay with an essentially linear end edge and inserting the stay comprises orienting the stay with the linear end edge extending generally perpendicularly across the channel in facing relation to the stitch.

16. A method of forming a knitted collar for a casual shirt according to claim 9, wherein providing the stay comprises forming the stay with a rounded end edge opposite the linear end edge and inserting the stay comprises orienting the stay with the rounded end edge disposed in facing relation to the closed channel end.

* * * * *